United States Patent [19]

Michel

[11] 4,002,182

[45] Jan. 11, 1977

[54] DEVICE FOR STORING AND APPLYING COSMETICS

[76] Inventor: Aubrey Jonathan Michel, Treetops, Mount Park Road, Harrow-on-the-Hill, Middlesex, England

[22] Filed: Oct. 9, 1975

[21] Appl. No.: 621,191

[30] Foreign Application Priority Data

Oct. 9, 1974 United Kingdom ..... 43766/74

[52] U.S. Cl. ..... 132/88.7; 401/202

[51] Int. Cl.[2] ..... A45D 40/26

[58] Field of Search ..... 132/88.7, 88.5; 401/217, 227, 126, 130, 202, 186

[56] References Cited

UNITED STATES PATENTS

| | | | |
|---|---|---|---|
| 1,021,522 | 3/1912 | Hinsdale | 401/202 |
| 1,098,976 | 6/1914 | Rosenstein | 401/202 |
| 2,399,162 | 4/1946 | Bloecher | 132/88.7 |
| 3,739,789 | 6/1973 | Cataneo | 132/88.7 |

*Primary Examiner*—G.E. McNeill

*Attorney, Agent, or Firm*—Ladas, Parry, Von Gehr, Goldsmith & Deschamps

[57] ABSTRACT

The invention provides a container for flowable material and a cap for the container, the cap has a shoulder which, when in position on the mouth of the container presses the wall of the container inwards around the mouth against a plug-like body positioned in the container near the mouth, thus restricting or preventing flow through the peripheral space around the plug-like body, thereby preventing leakage when the cap is in position.

1 Claim, 13 Drawing Figures

DEVICE FOR STORING AND APPLYING COSMETICS

BACKGROUND OF THE INVENTION

The invention relates to a device for storing and applying cosmetics or any other suitable product.

Cosmetic preparations, packed in tubes, are transferred to the skin indirectly — i.e. by finger, cotton wool, brush etc. The user's fingers are often soiled — an inconvenience when washing facilities are not readily available.

There is the added disadvantage that surplus product can easily be discharged from the tube by inadvertently applying excess pressure with the result that clothing or property can be damaged.

Indirect application of liquids requires a component for application. When fingertips are not used, the applicator has to be suitably stored and is an additional item to be carried.

The aim of the invention is to overcome these disadvantages.

According to the invention a container for flowable material and cap therefor characterised in that a body is provided near the container mouth partially plugging said mouth so that cosmetic material can only flow through a peripheral space between the body and the container wall and in that the cap has a shoulder which, when the cap is in position on the container, presses the container wall inwards, closing or restricting said peripheral space to prevent leakage of cosmetic material.

The invention will be further described with reference to the accompanying drawings, which illustrate the apparatus constituting various embodiments of the invention and are given by way of example and not by way of limitation.

DESCRIPTION

Figure 1:
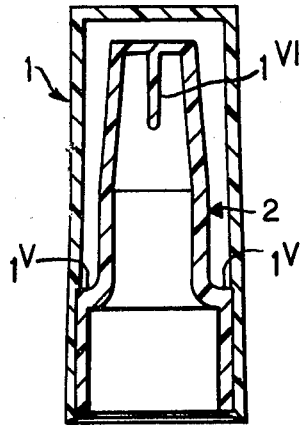
FIG. 1 illustrates the protective cap.
Figure 3:
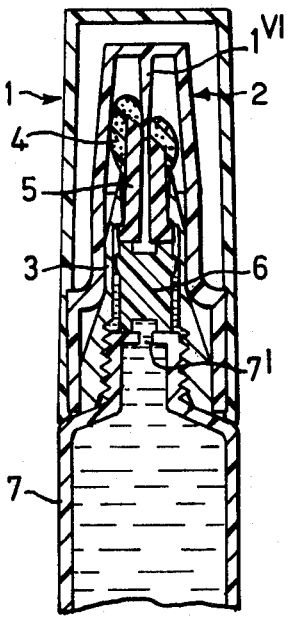
FIG. 3 shows the cross section of the tube, applicator and protective cap.
Figure 7:
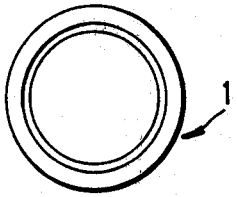
FIG. 7 shows an underneath plan view of the component illustrated in FIG. 6.
Figure 8:
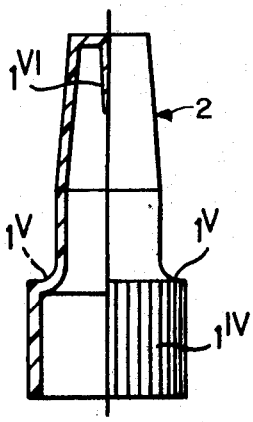
FIG. 8 shows a partly elevational and partly sectional view of another component of the cap.
Figure 2:
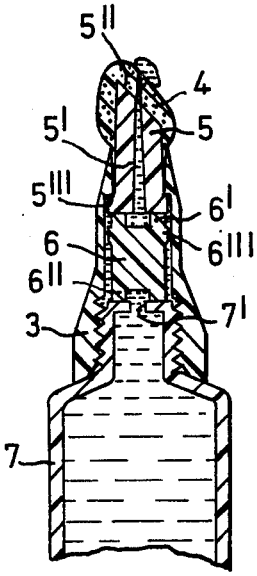
FIG. 2 shows the cross section of the tube and applicator with the flow of the liquid shaded - without protective cap.
Figure 6:
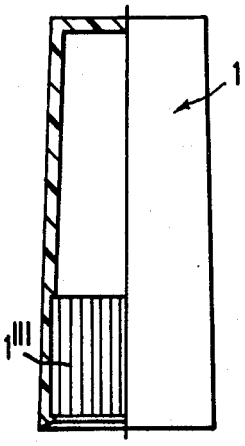
FIG. 6 shows a partly elevational and partly sectional view of one component of the protective cap.
Figure 9:
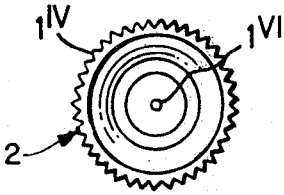
FIG. 9 shows an underneath plan view of the component illustrated in FIG. 8.
Figure 10:
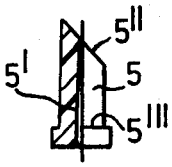
FIG. 10 shows a partly elevational and partly sectional view of a second component of the applicator.
Figure 12:
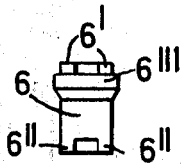
FIG. 12 shows an elevational view of a third component of the applicator.
Figure 4:
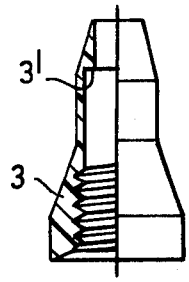
FIG. 4 shows a partly elevational and partly sectional view of one component of the applicator.
Figure 5:
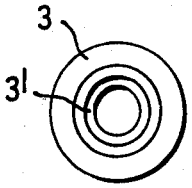
FIG. 5 shows an underneath plan view of the component illustrated in FIG. 4.
Figure 11:
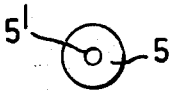
FIG. 11 shows an underneath plan view of the component illustrated in FIG. 10.
Figure 13:
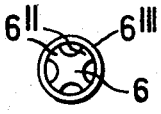
FIG. 13 shows an underneath plan view of the component illustrated in FIG. 12.

A pocket 4 of a suitably soft porous or perforated material is placed over the valve 5. This assembled unit is then placed inside the cone 3 so that the angled face 5.II of the valve covered by the pocket 4 is protruding. The angled face is then used for applying the producted contained in the tube 7. The shoulder 5.III of the valve fits into the recess 3.I of the cone and thus prevents the valve 5 and pocket 4 from being pulled out.

The flow control unit 6 is placed below the valve 5 in the cone and rests on top of the tube 7 thus applying the necessary pressure to hold the valve and pocket in place.

The cone 3 is attached to the neck of the tube 7 by screwing the two units together. Alternative methods of fixing could be utilized — i.e. welding, adhesive, friction/interference fit.

The flow control unit 6 has four 'legs' 6.I and 6.II at either end to allow the fluid to flow up from the opening 7.I in the tube, up the sides of the unit 6, past the shoulder 6.III and through the opening 5.I in the valve. The flow and consequent pressure required on the tube in order to push through the product, can be varied by adjusting the diameter of the shoulder 6.III, the result being that this invention can be adapted to fluids with a wide range of viscosities.

The protective cap has the following functions:

a. It keeps the applicator face free of contamination whilst not in use.

b. Prevents the product from drying out.

c. Seals the product into the tube so that any accidental pressure during carriage, storage etc., will not result in the fluid leaking out. This is achieved by the angle 1.V of the protective cap applying pressure on the cone. The cone, being manufactured of soft material is pressed against the shoulder 6.III of the flow control unit. Pressure applied, when the protective cap is in position will force the product to the shoulder of the flow control unit but no further as the gap between the shoulder and cone has been shut off. When the protective cap is removed the pressure fcrces the cone back and the product can once again flow freely. As an additional precaution a pin 1.VI can be made in the cap to rest in the opening 5.I of the valve. The protective cap is designed to enable the sealing mechanism to work and avoid drying out. An outer shell 1 can be made and assembled to the inner shell 2 by means of vertical intermeshing grooves 1.III and 1.IV to stop twisting and a recessed area to prevent the two units coming apart. This would overcome any asthetic problems as the cap can then be made to a wide range of shapes and sizes.

Various modifications may be made within the scope of the invention.

I claim:

1. Container for flowable material and cap therefor characterised in that a body is provided near the container mouth partially plugging said mouth so that cosmetic material can only flow through a peripheral space between the body and the container wall and in that the cap has a shoulder which, when the cap is in position on the container, presses the container wall inwards, closing or restricting said peripheral space to prevent leakage of cosmetic material.

* * * * *